US012685911B2

(12) United States Patent
Wirström et al.

(10) Patent No.: US 12,685,911 B2
(45) Date of Patent: Jul. 21, 2026

(54) TABLE TENNIS RACKET

(71) Applicant: STIGA Sports AB, Eskilstuna (SE)

(72) Inventors: Carl Filip Wirström, Eskilstuna (SE); Jörgen Lindström Jensen, Stockholm (SE)

(73) Assignee: STIGA Sports AB, Eskilstuna (SE)

( * ) Notice: Subject to any disclaimer, the term of this patent is extended or adjusted under 35 U.S.C. 154(b) by 316 days.

(21) Appl. No.: 18/697,261

(22) PCT Filed: Oct. 4, 2022

(86) PCT No.: PCT/SE2022/050884
§ 371 (c)(1),
(2) Date: Mar. 29, 2024

(87) PCT Pub. No.: WO2023/059249
PCT Pub. Date: Apr. 13, 2023

(65) Prior Publication Data

US 2024/0408463 A1 Dec. 12, 2024

(30) Foreign Application Priority Data

Oct. 6, 2021 (SE) ..... 2151226-4

(51) Int. Cl.
*A63B 59/45* (2015.01)
*A63B 60/06* (2015.01)
*A63B 102/16* (2015.01)

(52) U.S. Cl.
CPC ..... *A63B 59/45* (2015.10); *A63B 60/06* (2015.10); *A63B 2102/16* (2015.10)

(58) Field of Classification Search
CPC ..... A63B 59/45; A63B 60/06; A63B 2102/16; A63B 59/42; A63B 59/40; A63B 60/00
See application file for complete search history.

(56) References Cited

U.S. PATENT DOCUMENTS

| | | | | |
|---|---|---|---|---|
| 3,954,266 | A | 5/1976 | Carrano et al. | |
| 5,139,258 | A | 8/1992 | McPoyle | |
| 2005/0181895 | A1 | 8/2005 | Popovich | |
| 2012/0015765 | A1* | 1/2012 | Feng | A63B 60/10 473/551 |
| 2018/0015341 | A1* | 1/2018 | Planakis | A63B 60/34 |

FOREIGN PATENT DOCUMENTS

| | | | |
|---|---|---|---|
| CN | 207954918 | U | 10/2018 |
| DE | 26 32 820 | A1 | 2/1977 |
| EP | 0 213 467 | A1 | 3/1987 |

(Continued)

OTHER PUBLICATIONS

Extended European Search Report mailed Aug. 18, 2025, issued in corresponding European Patent Application No. 22 87 9018.4 filed Oct. 4, 2022, 6 pages.

(Continued)

*Primary Examiner* — Kristy A Haupt
(74) *Attorney, Agent, or Firm* — Christensen O'Connor Johnson Kindness PLLC

(57) ABSTRACT

A table tennis racket 1 characterized in that the circumference of the blade 3 comprises a plurality of straight portions 9*a-g*, and in that the handle 2 is aligned with a central longitudinal axis 8 of the racket 1.

4 Claims, 2 Drawing Sheets

(56) References Cited

FOREIGN PATENT DOCUMENTS

| | | | |
|---|---|---|---|
| EP | 1 625 878 | A1 | 2/2006 |
| GB | 1 514 625 | A | 6/1978 |
| KR | 20070078759 | A | 8/2007 |

OTHER PUBLICATIONS

International Search Report and Written Opinion mailed Oct. 27, 2022, issued in corresponding International Patent Application No. PCTSE2022050884, 13 pages.
International Preliminary Report on Patentability mailed Oct. 25, 2023, issued in corresponding International Patent Application No. PCTSE2022050884, 19 pages.
Office Action mailed Mar. 3, 2022, issued in corresponding Swedish Application No. Patent application No. 2151226-4, 7 pages.
Office Action mailed Aug. 31, 2023, issued in corresponding Swedish Application No. Patent application No. 2151226-4, 5 pages.

* cited by examiner

TABLE TENNIS RACKET

TECHNICAL FIELD

The present disclosure relates to sports rackets and more specifically to table tennis rackets.

BACKGROUND

Table tennis, also known as ping-pong, is a sport in which two or four players hit a lightweight ball to strike the ball back and forth across a table using table tennis rackets. The game takes place on a hard table divided by a net. The game moves fast and it is challenging to control the ball, including the direction of movement and spin of the ball.

Throughout the history of table tennis quite a few technical advancements have been made before arriving at the modern type rackets we see today. Early day's rackets with a hard wooden core were covered on each side cork and later-on with rubber sheets. The use of rubber sheets allowed the players to spin the ball, thus changing the dynamics of the game.

International rules for table tennis allow different surface materials to be provided on each respective side of the paddle, which allows for various amounts of spin or speed to be applied to the ball upon striking it depending on which side of the racket is used by the player. For example, a player may have a spin-heavy rubber on one side of his paddle, and no spin on the other side. The player can flip the racket in play for different types of returns. The rubber coating may be of pimpled rubber, with the pimples/pips outward, or it may be composed of a sponge layer, covered by rubber that may have the pimples pointed inwards or outwards. Also, various types of glues have proven to provide different characteristics to the racket.

To help a player distinguish between different types of rubber used by his opponent, regulations specify that one side of a paddle must be red while the other must be black, allowing a player to see what side of a paddle hits the ball. A player has the right to inspect his opponent's racket before a match to assess the characteristics and color of each side of the racket.

A modern racket typically comprises a handle, a blade connected to the handle, sponge layers on the blade and rubber layers applied on the sponge. We can thus conclude that there are a lot of ideas on how to improve table tennis rackets to provide different effects on the ball. However, skills and handling of the racket is still detrimental for the success of a player.

SUMMARY

An objective of the present disclosure is to provide a new table tennis racket enabling improved ball control.

According to a first aspect of the present disclosure this objective is achieved by a table tennis racket as defined in claim 1 with various alternative embodiments of the table tennis racket defined in the dependent claims. The table tennis racket comprises a handle and a blade, wherein the blade comprises a base portion connected to the handle. The blade comprises a first side for attachment of one or more primary cover layers and an opposite second side for attachment of one or more secondary cover layers. Also, the blade is symmetrical about a first plane, said first plane being perpendicular to the first side and said first plane being aligned with a central longitudinal axis of the table tennis racket. The circumference of the blade comprises a plurality of straight portions (9*a-g*), and the handle is aligned with the central longitudinal axis.

The straight edges provide clear visual references for the player and thus enables the player to get a better perception of the orientation and position of the racket during game play. The symmetry of the blade about the first plane enables the player to change grip by flipping the racket 180 degrees during game play to enable use of either one of the first or second sides for forehand use/backhand use respectively whilst still offering unchanged geometry of the circumference relatively the player's hand. Hence, the present table tennis racket design enables improved ball control by combining visual references with side-selection-independent geometry.

The handle may be symmetric about the first plane.

By making the handle symmetric about the first plane, the user can get the exact same grip independent of what side of the racket is used during play as forehand/backhand side. The symmetric handle also makes the racket equally well suited for use by lefthanded and a righthanded persons and thus enables sharing of racket in a group of people including both lefthanded and righthanded people.

The portion of the handle connecting to the blade may have a width of less than 25% of the maximum width of the blade.

By keeping the handle narrow where it is connected to the base portion of the blade, the risk of the handle striking the ball is low since there are no portions of the handle protruding above the blade to the left or to the right of the stem f the handle.

The plurality of straight portions may comprise a straight front portion extending perpendicularly to the first plane.

By providing the racket with a straight front portion extending perpendicularly to the first plane, the surface area of the front portion of the blade is widened for the same length of racket as compared to a standard racket with an overall rounded circumference of the blade. This is advantageous when playing close to the net or doing other far-reaching strikes since the area available to strike the ball with is increased at the front portion of the racket.

The plurality of straight portions may also comprise

- a front-left side portion extending obliquely outwards from a left end of the straight front portion, and
- a corresponding front-right side portion extending obliquely outwards from a right end of the straight front portion.

Also, the plurality of straight portions may comprise

- a left intermediate side portion extending from the front-left side portion towards the base portion, and
- a corresponding right intermediate side portion extending from the front-right side portion towards the base portion.

The plurality of straight portions may further comprise a rear-left side portion extending from the left intermediate side portion to the handle, and

- a corresponding rear-right side portion extending from the right intermediate side portion to the handle.

The table tennis racket may comprise the primary cover layer(s) and the secondary cover layer(s), wherein the primary cover layer is be different from the secondary cover layer by differing in color, material, and/or surface structure.

The provision of different cover layers on each side of the racket enables the player to use each side's unique properties as desired to vary the strokes and adapt them to the situation or to confuse the opponent. The surface structure may for example be smooth or it may comprise pips extending outwards.

The material(s) of the primary and secondary cover layers may be rubber sheet material(s).

| | |
|---|---|
| 1 | table tennis racket |
| 2 | handle |
| 3 | blade |
| 4 | base portion of blade |
| 5 | primary cover layer(s) |
| 6 | secondary cover layer(s) |
| 7 | first plane |
| 8 | central longitudinal axis |
| 9a | front straight portion of blade |
| 9b | front-left side portion |
| 9c | front-right side portion |
| 9d | left intermediate side portion |
| 9e | right intermediate side portion |
| 9f | rear-left side portion |
| 9g | rear-right side portion |
| W1 | width of handle at connection to blade |
| W2 | maximum width of blade |
| TL | total length of the table tennis racket |

DETAILED DESCRIPTION

Figure 1:
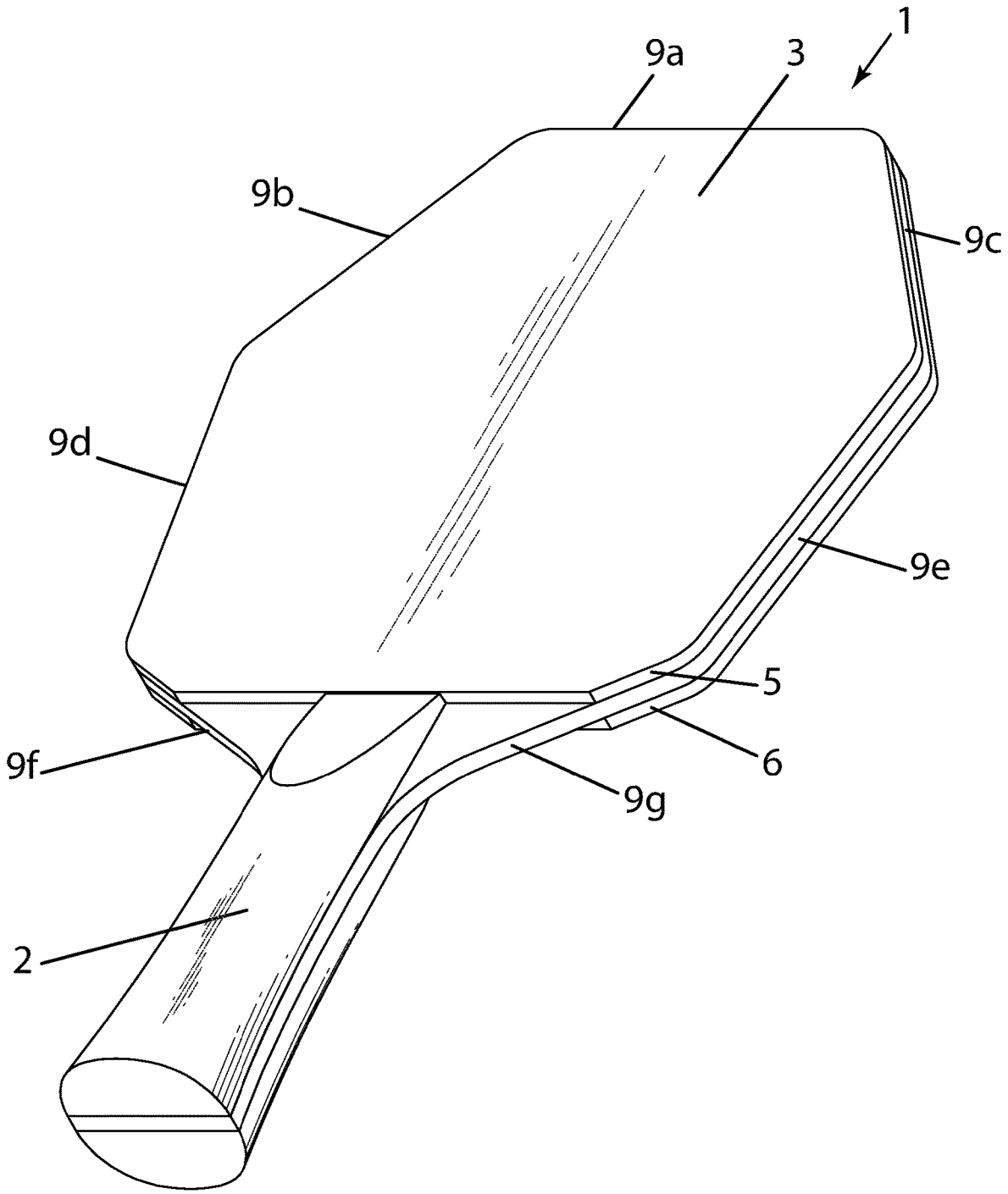
FIG. 1 shows a perspective view of a first embodiment of a table tennis.

A table tennis racket 1 according to a first embodiment of the invention will hereinafter be described with reference to FIGS. 1-3.

The table tennis racket 1 comprises a handle 2 and a blade 3, wherein the blade 3 comprises a base portion 4 connected to the handle 2. Also, the blade 3 comprises a first side for attachment of one or more primary cover layers 5 and an opposite second side for attachment of one or more secondary cover layers 6. In this embodiment, the racket comprises the primary 5 and secondary 6 cover layers but in other embodiments, the table tennis racket 1 could alternatively be provided without the primary 5 and secondary 6 cover layers such that the customer can buy any type of cover layers and apply them to the blade 3. The material(s) of the primary 5 and secondary 6 cover layers is/are rubber sheet material(s). But could in other embodiments alternatively be some other type of materials, such as thermoplastics, and could comprise a sandwich structure of multiple materials such as a foamed material facing the blade 3 and a surface made of rubber or thermoplastics. The primary cover layer is different from the secondary cover layer 6 by differing in color, material, and/or surface structure. In this embodiment, the primary cover layer 5 is red and the secondary cover layer black, but in other embodiments, they could have the same color, or other colors. In this embodiment, the materials of the primary cover layer 5 and the secondary cover layer 6 are different but in other embodiments, the materials could be the same and the cover layers 5, 6 could even be of the same type and color.

Figure 2:
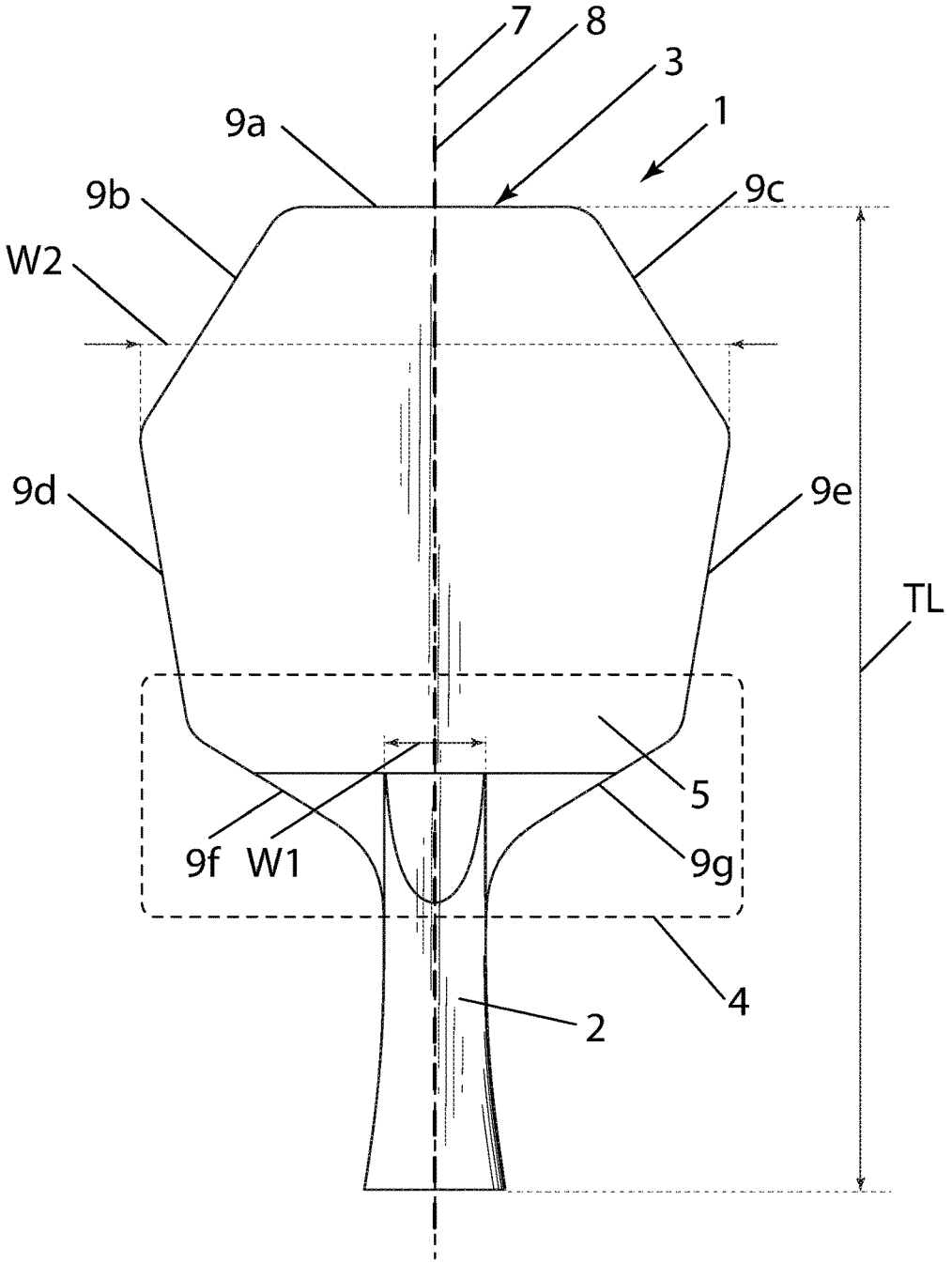
FIG. 2 shows a top view of the table tennis racket also shown in FIG. 1.
Figure 3:
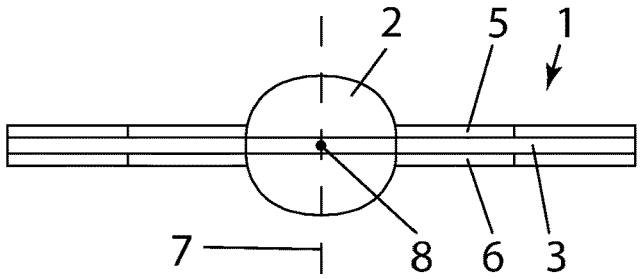
FIG. 3 shows a back view of the table tennis racket also shown in FIGS. 1-2.

The blade 3 is symmetrical about a first plane 7, said first plane 7 being perpendicular to the first side and said first plane being aligned with a central longitudinal axis 8 of the table tennis racket 1, as shown in FIGS. 2 and 3. The circumference of the blade 3 comprises a plurality of straight portions 9*a-g*, and in that the handle 2 is aligned with the central longitudinal axis 8.

The straight edges provide clear visual references for the player and thus enables the player to get a better perception of the orientation and position of the racket during game play. The symmetry of the blade about the first plane enables the player to change grip by flipping the racket 180 degrees during game play to enable use of either one of the first or second sides for forehand use/backhand use respectively whilst still offering unchanged geometry of the circumference relatively the player's hand. Hence, the present table tennis racket design enables improved ball control by combining visual references with side-selection-independent geometry.

The handle 2 is symmetric about the first plane 7 but could in other embodiments alternatively be asymmetric about the first plane.

By making the handle symmetric about the first plane, the user can get the exact same grip independent of what side of the racket is used during play as forehand/backhand side. The symmetric handle also makes the racket equally well suited for use by lefthanded and a righthanded persons and thus enables sharing of racket in a group of people including both lefthanded and righthanded people.

The portion of the handle 2 connecting to the blade 3 has a width W1 of less than 25% of the maximum width W2 of the blade 3. The widths W1, W2 are shown in FIG. 2. It should be understood this requirement is to exclude any shapes of the handle extending over either one of the first and second blade sides along either one of the back edges of the blade to the handle 3, such that the table tennis racket 1 has an essentially planar surface all the way from the front of the racket and to the back of the bracket at the base portion. By keeping the handle narrow where it is connected to the base portion of the blade, the risk of the handle striking the ball is low since there are no portions of the handle protruding above the blade to the left or to the right of the stem of the handle.

The plurality of straight portions 9*a-g* comprise a straight front portion 9*a* extending perpendicularly to the first plane 7. The plurality of straight portions 9*a-g* also comprise a front-left side portion 9*b* extending obliquely outwards from a left end of the straight front portion 9*a*, and a corresponding front-right side portion 9*c* extending obliquely outwards from a right end of the straight front portion 9*a*. Also, the plurality of straight portions 9*a-g* comprise a left intermediate side portion 9*d* extending from the front-left side portion 9*b* towards the base portion 4, and a corresponding right intermediate side portion 9*e* extending from the front-right side portion 9*c* towards the base portion 4. Finally, the plurality of straight portions 9*a-g* further comprise a rear-left side portion 9*f* extending from the left intermediate side portion 9*d* to the handle 2, and a corresponding rear-right side portion 9*g* extending from the right intermediate side portion 9*e* to the handle 2.

In other embodiments, one or more of the straight portions 9*a-g* could be replaced by a curved edge as long as the circumference of the table tennis racket 1 comprises at least one straight portion. Also, although the straight portions in the depicted embodiment are symmetric about the first plane 7, at least some of the straight portions could in other embodiments alternatively be configured such that the blade 3 is asymmetric about the first plane 7. The handle and the blade are made of wood but could in other embodiments alternatively be made of any other suitable material.

The total length TL of the table tennis racket is 260 mm from the straight front portion to the end of the handle 2.

The invention claimed is:

1. A table tennis racket comprising a handle and a blade, wherein the blade comprises a base portion connected to the handle, wherein the blade comprises a first side for attachment of one or more primary cover layers and an opposite second side for attachment of one or more secondary cover layers, and wherein the table tennis racket is symmetrical about a first plane, said first plane being perpendicular to the first side and said first plane being aligned with a central longitudinal axis of the table tennis racket, wherein the circumference of the blade comprises a plurality of straight portions comprising a straight front portion extending perpendicularly to the first plane, a front-left side portion extending obliquely outwards from a left end of the straight front portion, a corresponding front-right side portion extending obliquely outwards from a right end of the straight front portion, a left intermediate side portion extending from the front-left side portion towards the base portion, a corresponding right intermediate side portion extending from the front-right side portion towards the base portion, a rear-left side portion extending from the left intermediate side portion to the handle, and a corresponding rear-right side portion extending from the right intermediate side portion to the handle, and in that the handle is aligned with the central longitudinal axis.

2. A table tennis racket according to claim 1, wherein the portion of the handle connecting to the blade has a width of less than 25% of the maximum width of the blade.

3. A table tennis racket according to claim 1, also comprising the primary cover layer(s) and the secondary cover layer(s), wherein the primary cover layer(s) is different from the secondary cover layer(s) by differing in color, material, and/or surface structure.

4. A table tennis racket according to claim 1, wherein the material(s) of the primary and secondary cover layers is/are rubber sheet material(s).

* * * * *